US006789555B1

(12) United States Patent
Thomas

(10) Patent No.: US 6,789,555 B1
(45) Date of Patent: Sep. 14, 2004

(54) UMBRELLA AND ARTICLE HOLDER

(76) Inventor: Clarence Thomas, 111-35 207th St., Queens Village, NY (US) 11429

( * ) Notice: Subject to any disclaimer, the term of this patent is extended or adjusted under 35 U.S.C. 154(b) by 77 days.

(21) Appl. No.: 10/205,186

(22) Filed: Jul. 25, 2002

(51) Int. Cl.[7] ..... A45B 3/00
(52) U.S. Cl. ..... 135/16
(58) Field of Search ..... 224/149, 575, 224/576, 577, 901.2, 901.4, 186, 222, 661; 135/16, 66; 248/311.2, 156

(56) References Cited

U.S. PATENT DOCUMENTS

| | | | | | |
|---|---|---|---|---|---|
| 1,111,524 | A | * | 9/1914 | Cohen | 108/135 |
| 1,755,209 | A | * | 4/1930 | Danner | 224/186 |
| 1,758,379 | A | | 5/1930 | Shaw | |
| 1,761,497 | A | | 6/1930 | Smith | |
| 2,210,493 | A | | 8/1940 | Lisi | |
| 3,892,251 | A | * | 7/1975 | Warfield | 135/15.1 |
| 4,261,494 | A | * | 4/1981 | Thomas | 224/614 |
| 4,318,567 | A | | 3/1982 | Guthier | |
| 4,681,246 | A | | 7/1987 | Andersson | |
| 5,056,545 | A | | 10/1991 | Spaeth | |
| D325,297 | S | | 4/1992 | Lipscomb et al. | |
| 5,101,845 | A | * | 4/1992 | Kravetz | 135/66 |
| 5,365,966 | A | | 11/1994 | McLaren | |
| 5,445,303 | A | * | 8/1995 | Cawile, Jr. | 224/222 |
| 5,500,952 | A | * | 3/1996 | Keyes | 2/465 |
| 5,597,363 | A | * | 1/1997 | Leote | 473/282 |
| 5,779,122 | A | * | 7/1998 | Martinelli | 224/683 |
| 5,803,325 | A | * | 9/1998 | Wang | 224/275 |
| 5,803,327 | A | | 9/1998 | Nipper et al. | |
| 5,823,213 | A | | 10/1998 | Patarra | |
| 5,878,762 | A | | 3/1999 | Huang | |
| D411,654 | S | | 6/1999 | Olkey et al. | |
| 5,941,435 | A | | 8/1999 | Munro, III | |
| 6,138,976 | A | | 10/2000 | Fahringer, Sr. | |
| 6,354,554 | B1 | * | 3/2002 | Hollenbeck | 248/530 |
| 6,357,639 | B1 | | 3/2002 | Williams | |

FOREIGN PATENT DOCUMENTS

| | | | |
|---|---|---|---|
| WO | 92/18030 | * 10/1992 | 135/16 |

* cited by examiner

*Primary Examiner*—Janet M. Wilkens
(74) *Attorney, Agent, or Firm*—Richard M. Goldberg

(57) ABSTRACT

An umbrella and article holder includes an umbrella having a shaft, a handle connected to one end of the shaft, and a fabric covering connected to an opposite end of the shaft and adapted to open up to provide a protective covering against rain, snow and sleet; at least one article holder connected with the handle of the umbrella for holding at least one article when the umbrella is held in an upright configuration; and a leg securing strap for securing the umbrella to a leg of a person such that the umbrella remains in the upright configuration whether the person is sitting or standing.

18 Claims, 13 Drawing Sheets

FIG.17
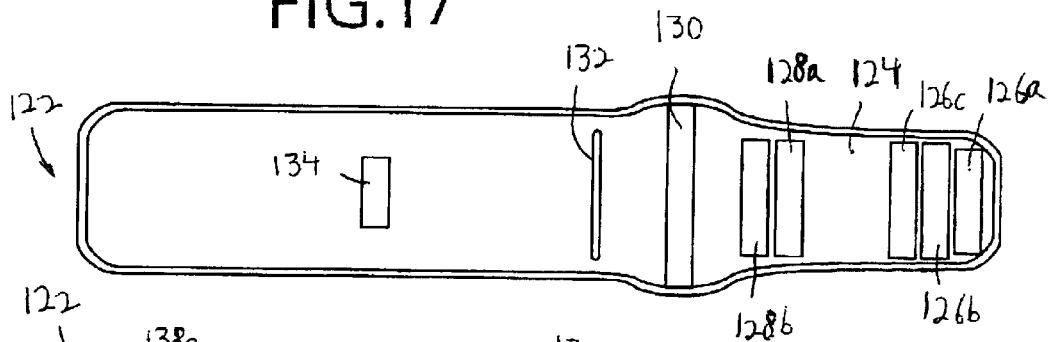
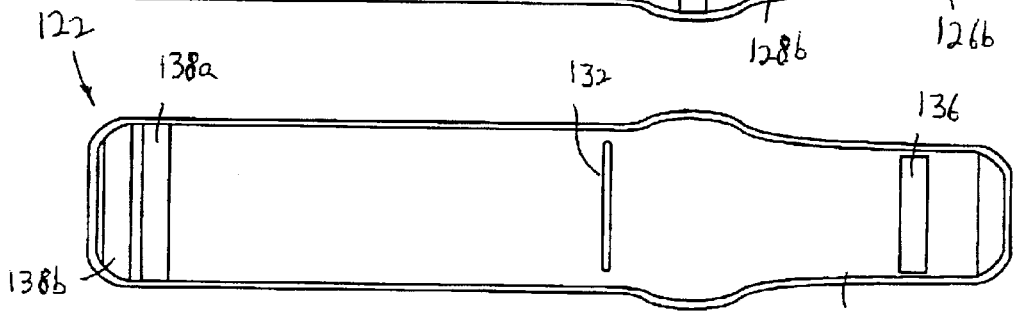
FIG.18
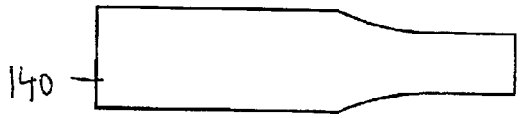
FIG.19

UMBRELLA AND ARTICLE HOLDER

BACKGROUND OF THE INVENTION

The present invention relates generally to umbrellas. Umbrellas are well known items for protecting a person against inclement weather, such as rain, snow, sleet, etc. Conventionally, umbrellas have been about three feet long with a handle that can be straight or curved. More recently, compact umbrellas about one-third the size of conventional umbrellas have been provided and which can fit within a briefcase or the like.

A problem with conventional longer umbrellas is where to place the umbrella when not in use. For example, when sitting or standing, and waiting for a train, it is not easy to position the umbrella to become unobtrusive, and oftentimes, the umbrella ends up falling down on the floor.

In addition, while sitting or standing, and waiting for a train, a person often is holding a drink while attempting to read a magazine, and at the same time, preventing the umbrella from falling on the floor. The person may also have shopping packages and/or a coat that must be laid to one side. All of the above together become very cumbersome to deal with.

Although it is known to provide bags, hooks, trays, etc. secured to pole like device for supporting items thereon, these known devices are not adequate for handling a person's many items, such as a drink, cigarettes, magazines, coat and/or parcels. Further, these devices must be separately assembled with the pole like devices, thereby increasing the cost and complexity thereof. Examples of such devices are disclosed in U.S. Pat. Nos. DES 325,297; DES 411,654; 1,758,379; 2,210,493; 5,056,545; 5,803,327; and 5,878,762.

It is also known to strap other pole like devices, such as a fishing rod, snow board pole or ski to a leg of a person, as disclosed in U.S. Pat. Nos. 1,761,497; 4,681,246; 5,941,435; 6,138,976; and 6,357,639; and to strap an umbrella to an arm of a person, as disclosed in U.S. Pat. No. 5,365,966. None of these pole like devices, however, are intended to hold extraneous items, and could not practically do so.

SUMMARY OF THE INVENTION

Accordingly, it is an object of the present invention to provide an umbrella and article holder that overcomes the problems with the aforementioned prior art.

It is another object of the present invention to provide an umbrella and article holder in which the umbrella has various holders molded into and/or secured to the handle for holding various items therein when the umbrella is held upright.

It is still another object of the present invention to provide an umbrella and article holder in which a leg strap is provided for securing the umbrella to a leg of a person to maintain the umbrella in an upright position, whether the person is standing or sitting, in order to hold the items in the holders of the handle.

It is yet another object of the present invention to provide an umbrella and article holder that is relatively inexpensive to manufacture and easy to use.

In accordance with an aspect of the present invention, an umbrella and article holder includes an umbrella having a shaft, a handle connected to one end of the shaft, and a fabric covering connected to an opposite end of the shaft and adapted to open up to provide a protective covering against rain, snow and sleet; at least one article holder connected with the handle of the umbrella for holding at least one article when the umbrella is held in an upright configuration; and a leg securing device for securing the umbrella to a leg of a person such that the umbrella remains in the upright configuration whether the person is sitting or standing.

The leg securing device includes a strap for securing the umbrella to the leg of the person. The strap includes at least one hook like fastener section and at least one loop like fastener section on opposite sides thereof for engagement with each other to secure the strap around the leg of the person and around the umbrella.

The strap further includes a slot for receipt of one end of the strap such that the one end extending through the slot can be secured to the strap by at least one hook like fastener section and at least one loop like fastener section to form a small diameter enclosure for wrapping about the umbrella, wherein an opposite end of the strap includes at least one hook like fastener section or at least one loop like fastener section and is adapted to be wrapped about a leg of a person and about the small diameter enclosure to engage with at least one other loop like fastener section and at least one other hook like fastener section on the strap to secure the strap about the leg of the person and about the small diameter enclosure.

Preferably, the strap includes a narrower width end portion which includes the one end.

The at least one article holder includes a drink holder, cigarette box holder, cigarette lighter holder and pen holder connected to an upper end of the handle, and a hook for holding at least one of a hat and coat and an extension for holding a shopping bag connected to a lower end of the handle, all of which are formed as a unitary, one-piece construction with the handle.

Further, a magazine holder is provided having an magazine rack for holding at least one magazine, and a connector to which the magazine rack is mounted, the connector having an opening through which the umbrella is adapted to fit in a friction on manner so that the magazine holder can be held at a desired height along the umbrella.

The above and other objects, features and advantages of the invention will become readily apparent from the following detailed description there of which is to be read in connection with the accompanying drawings.

BRIEF DESCRIPTION OF THE DRAWINGS

FIG. 17 is a top plan view of the securing strap;

FIG. 18 is a bottom plan view of the securing strap;

FIG. 19 is a plan view of an insert for the securing strap;

DETAILED DESCRIPTION

Figure 1:
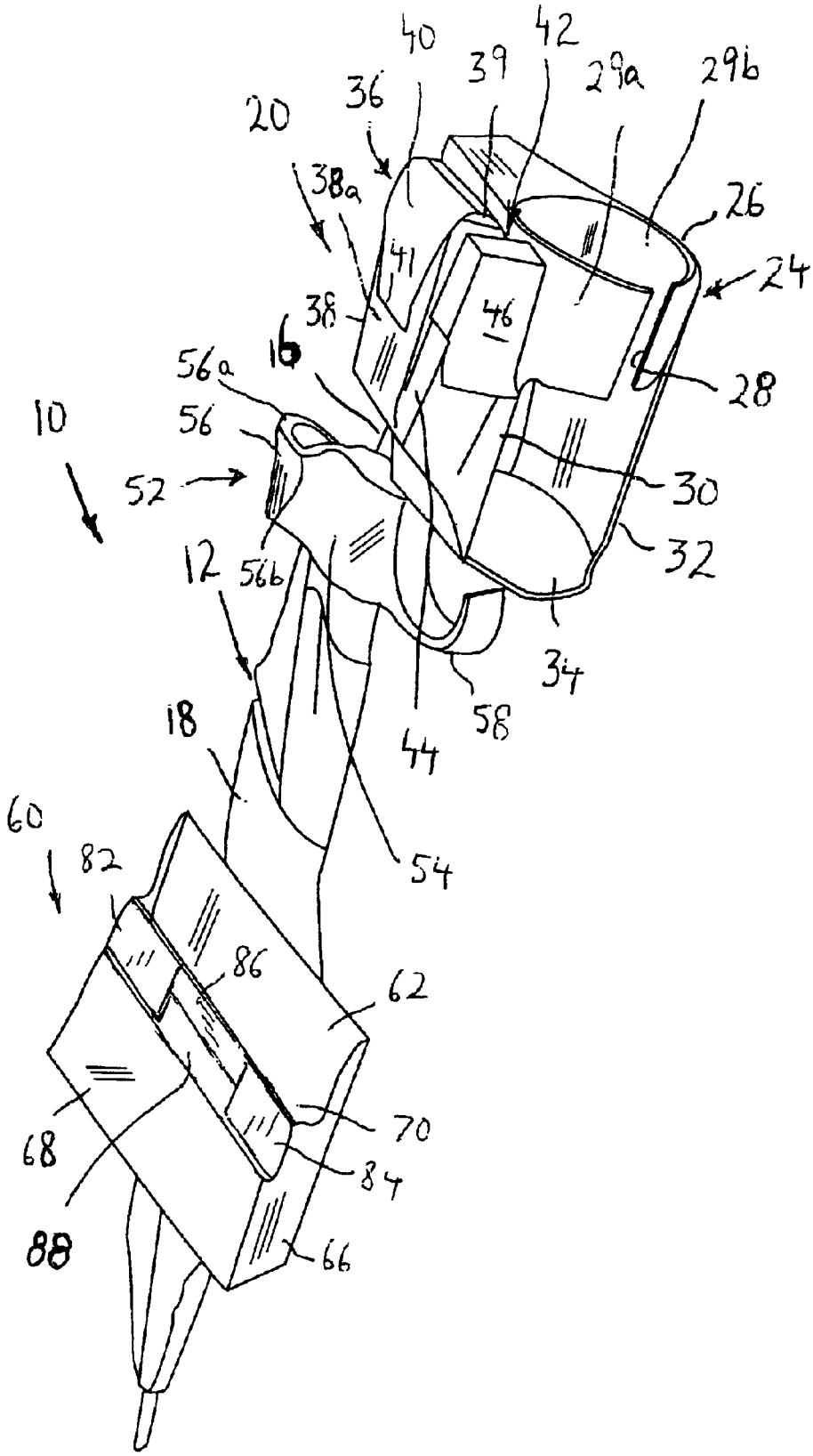
FIG. 1 is a perspective view of an umbrella and article holder according to a first embodiment of the present invention.

Referring to the drawings in detail, and initially to FIGS. 1–7, an umbrella and article holder 10 according to a first embodiment of the present invention includes a conventional umbrella 12 having an umbrella shaft 14 with a handle 16 at one end and a fabric covering 18 secured at the opposite end thereof. Fabric covering 18 can be opened into a protective configuration by a linkage mechanism which is conventional with umbrellas and is not shown. The linkage mechanism does not form part of the present invention.

In the embodiment of FIGS. 1–7, handle 16 has a straight configuration in line with umbrella shaft 14 and by which a user can grasp handle 16 and invert umbrella 180 degrees from the position shown in FIG. 1, for use of the umbrella as protection against the elements.

Figure 2:
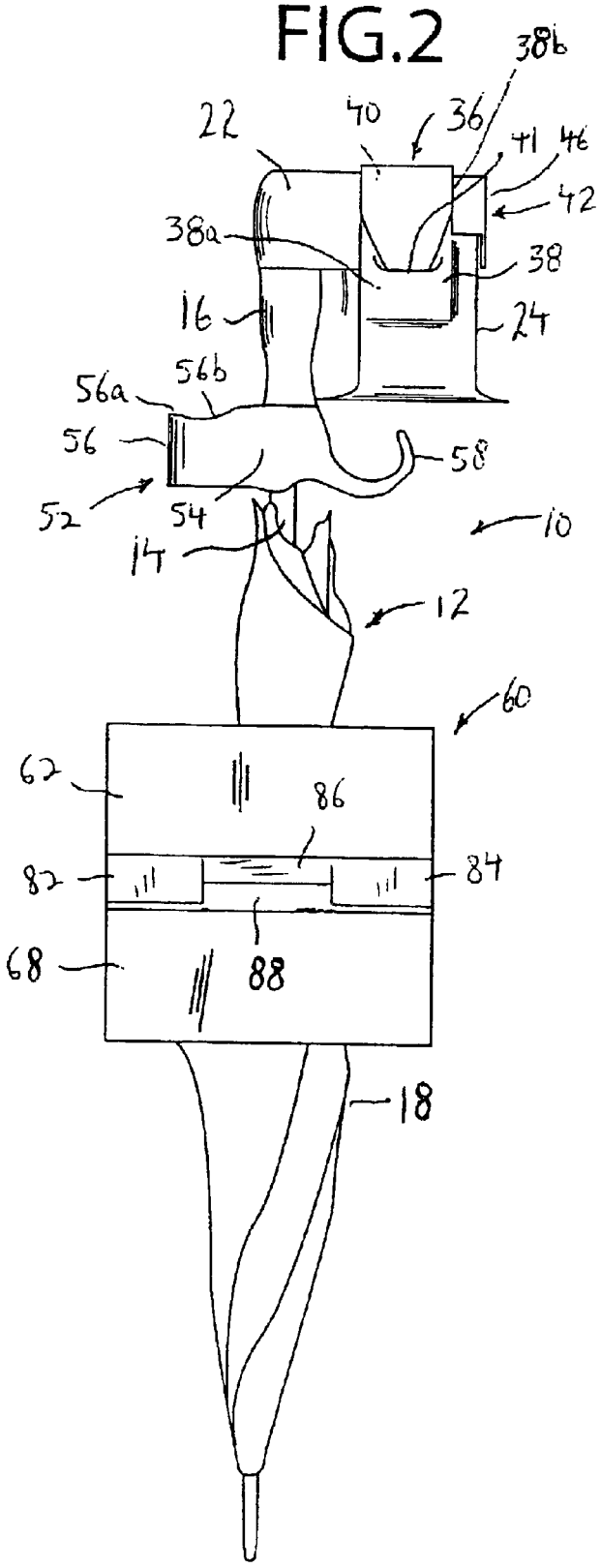
FIG. 2 is a left side elevational view of the umbrella and article holder.
Figure 3:
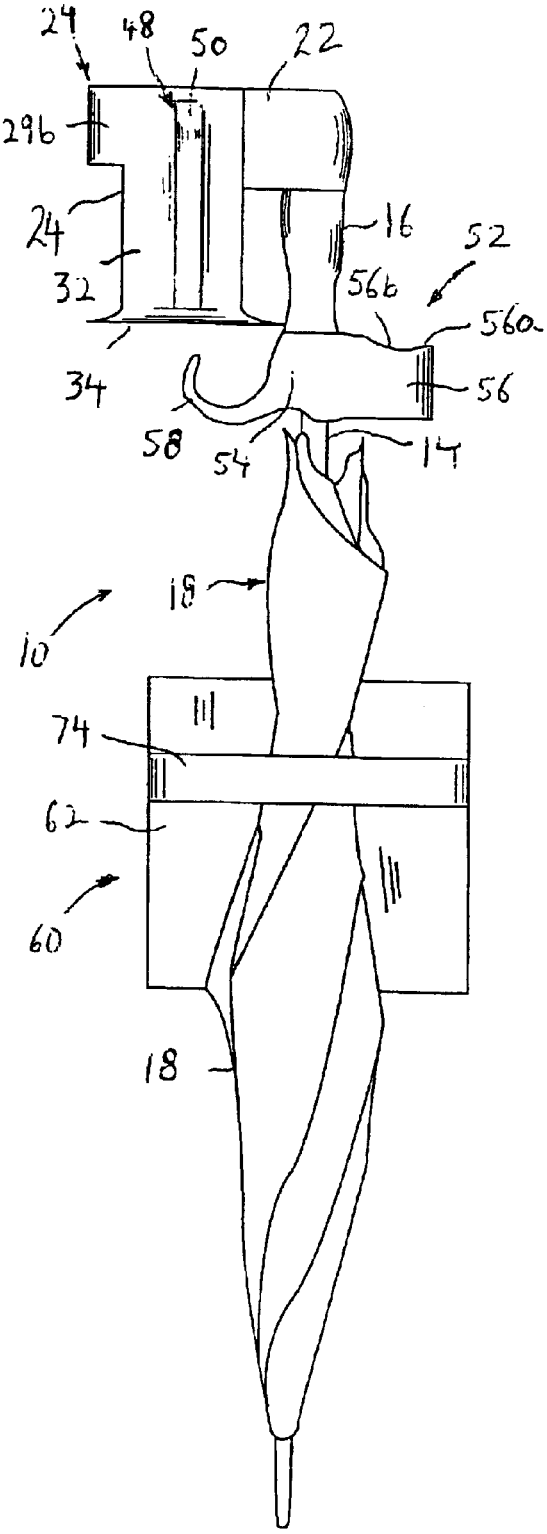
FIG. 3 is a right side elevational view of the umbrella and article holder.
Figure 4:
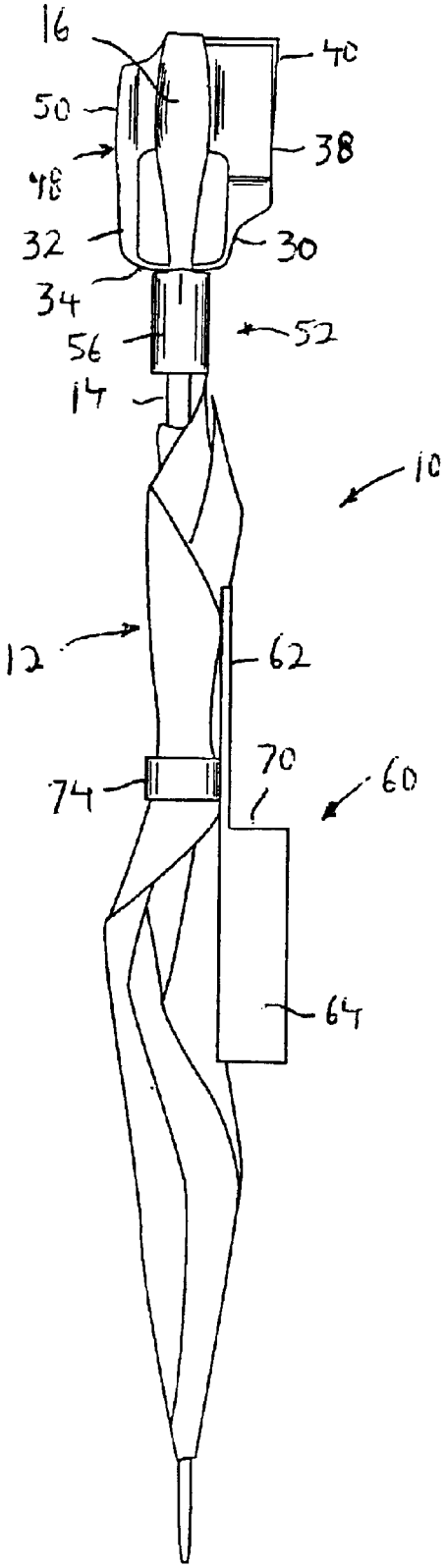
FIG. 4 is a rear elevational of the umbrella and article holder.
Figure 5:
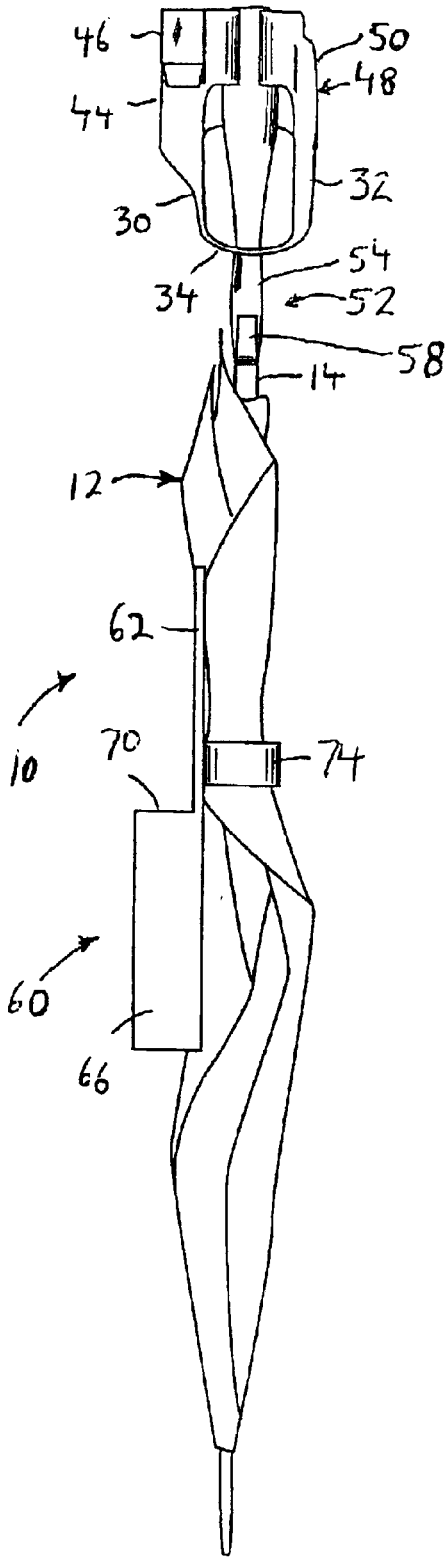
FIG. 5 is a front elevational view of the umbrella and article holder.
Figure 6:
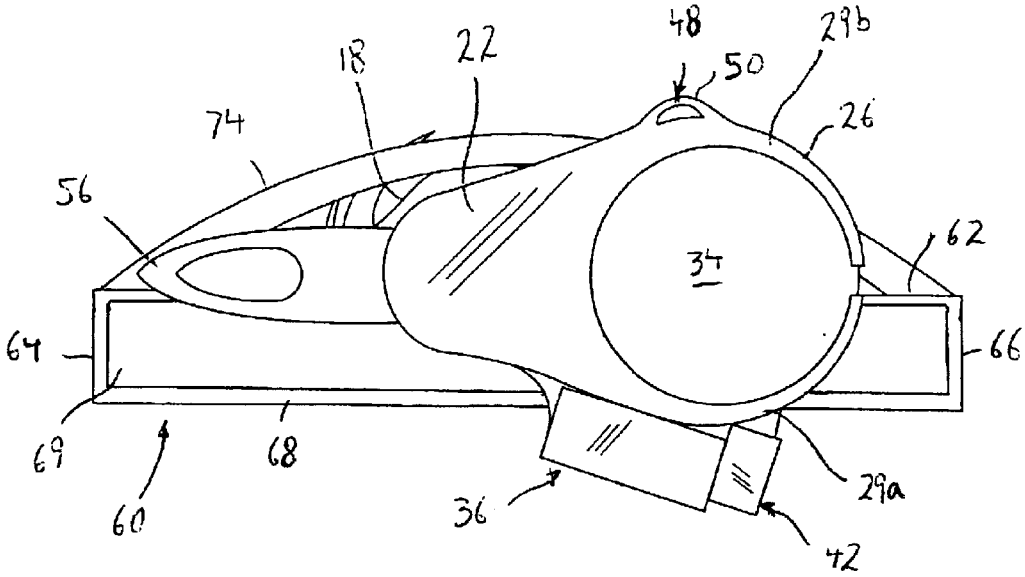
FIG. 6 is a top plan view of the umbrella and article holder.
Figure 7:
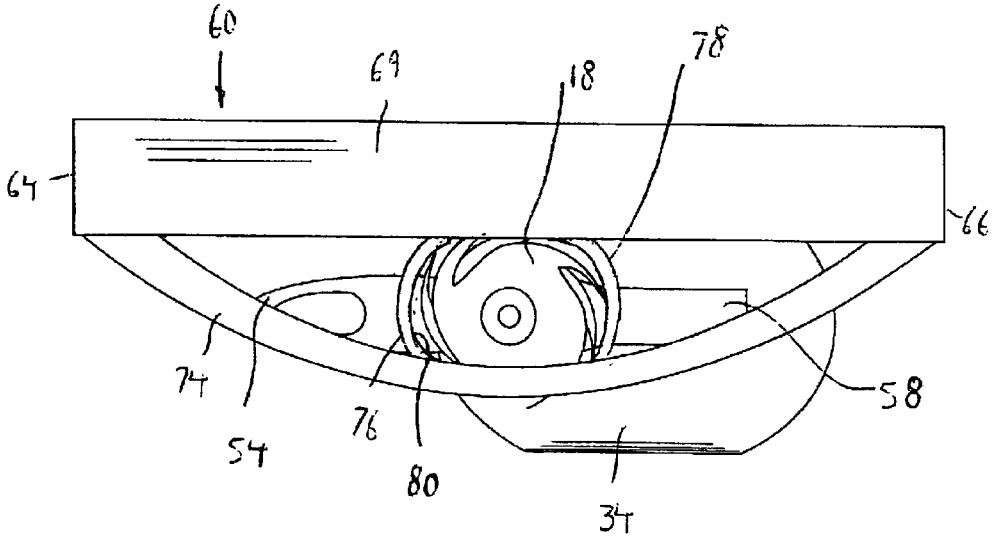
FIG. 7 is a bottom plan view of the umbrella and article holder.
Figure 8:
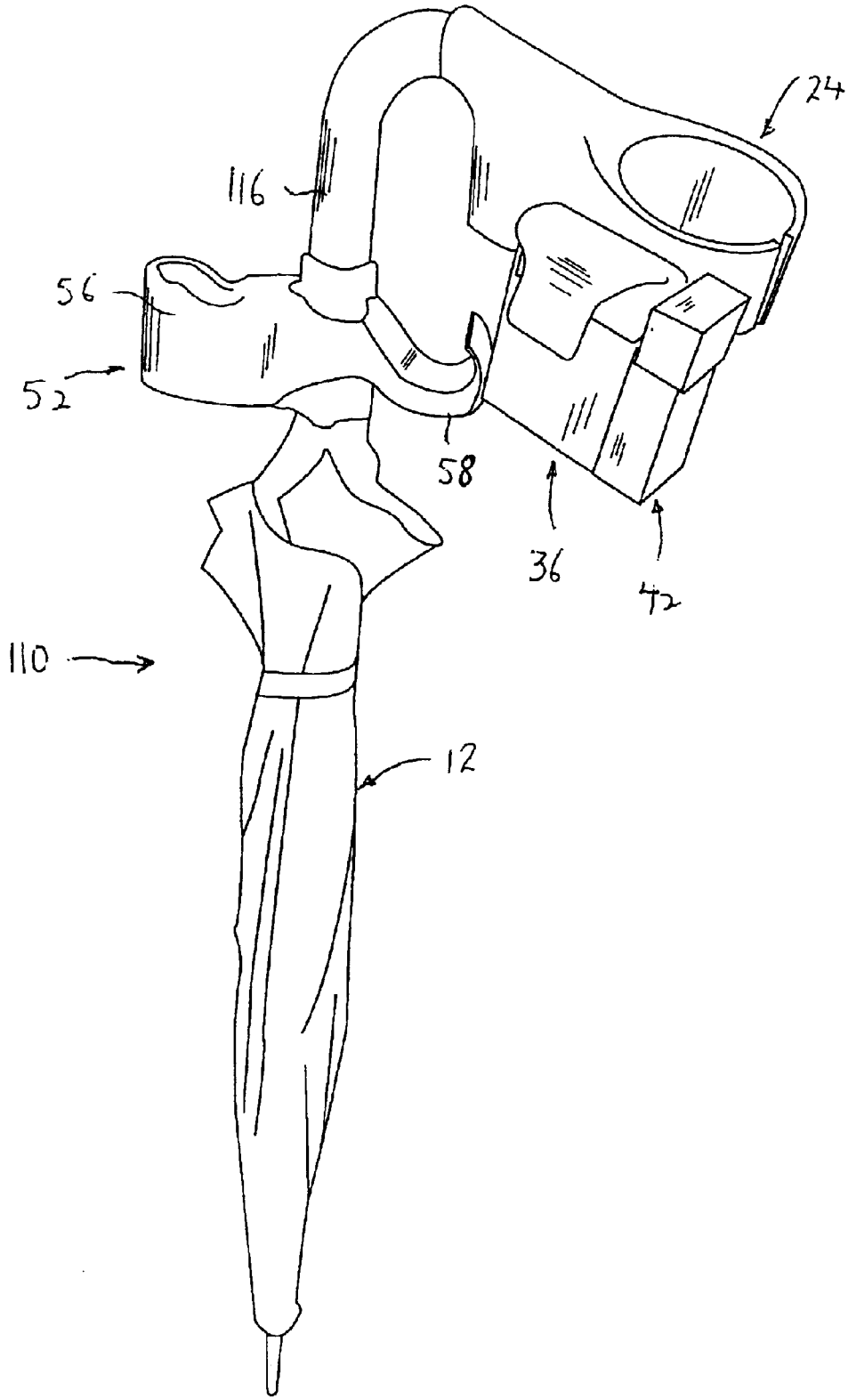
FIG. 8 is a perspective view of an umbrella and article holder according to a second embodiment of the present invention.
Figure 9:
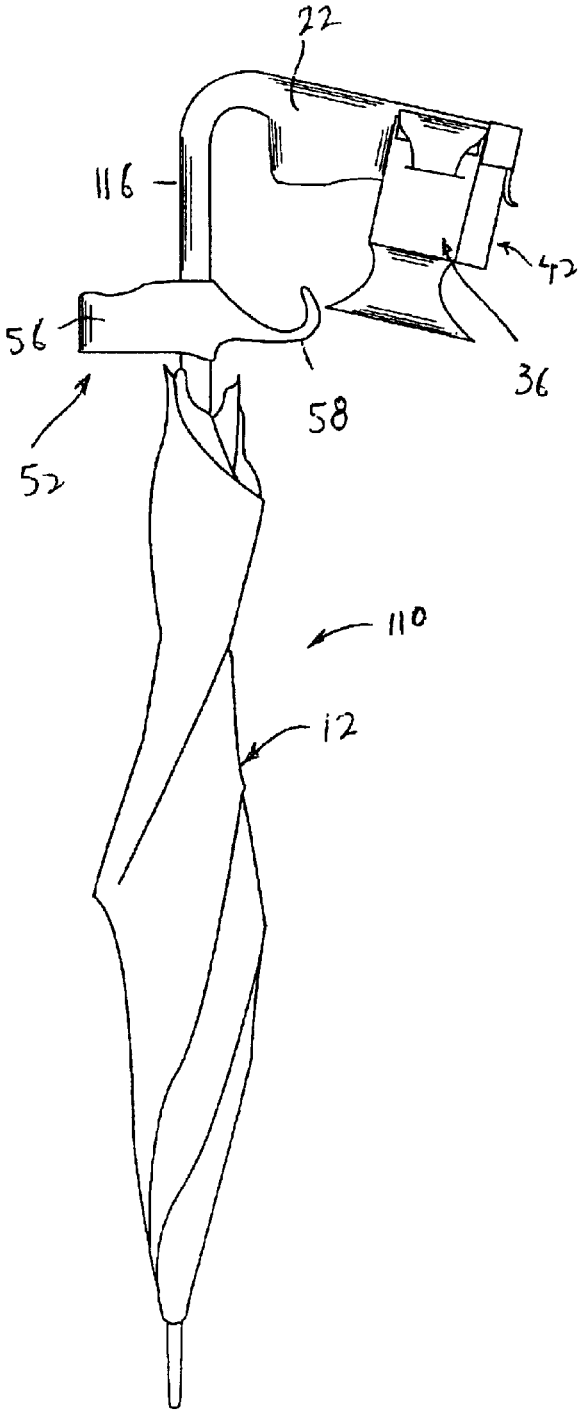
FIG. 9 is a left side elevational view of the umbrella and article holder of FIG. 8.
Figure 10:
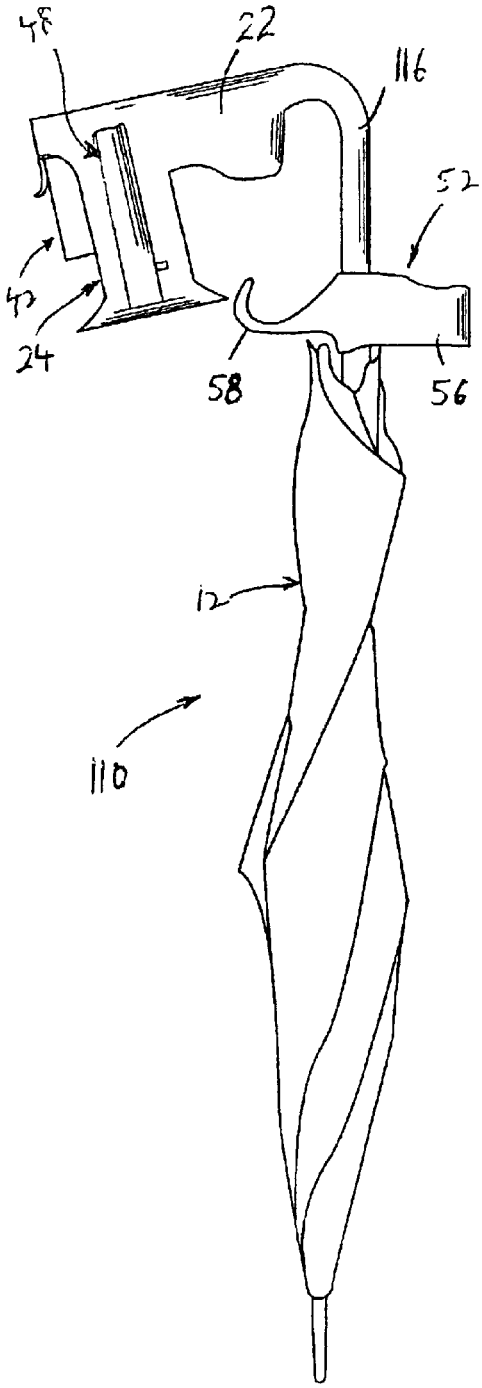
FIG. 10 is a right side elevational view of the umbrella and article holder of FIG. 8.
Figure 11:
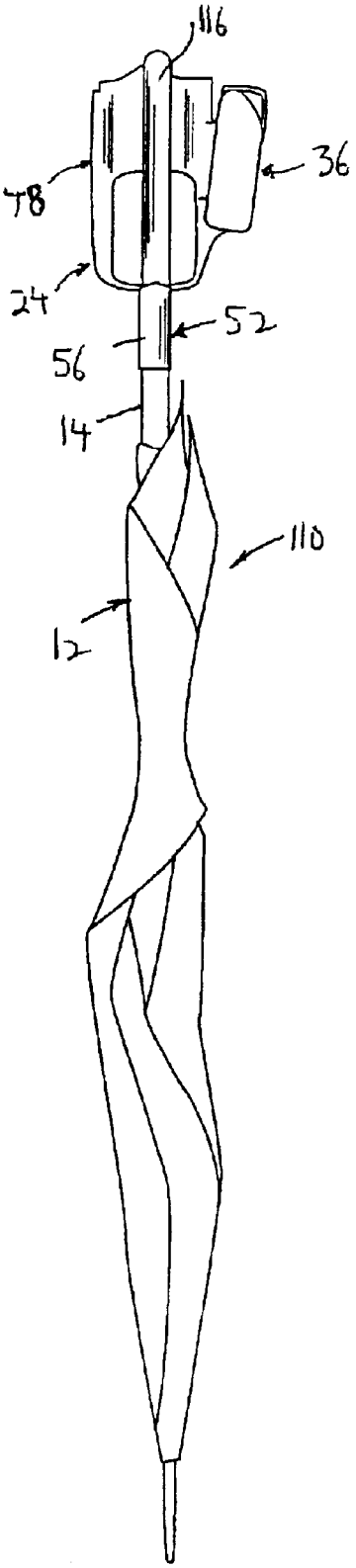
FIG. 11 is a rear elevational of the umbrella and article holder of FIG. 8.
Figure 12:
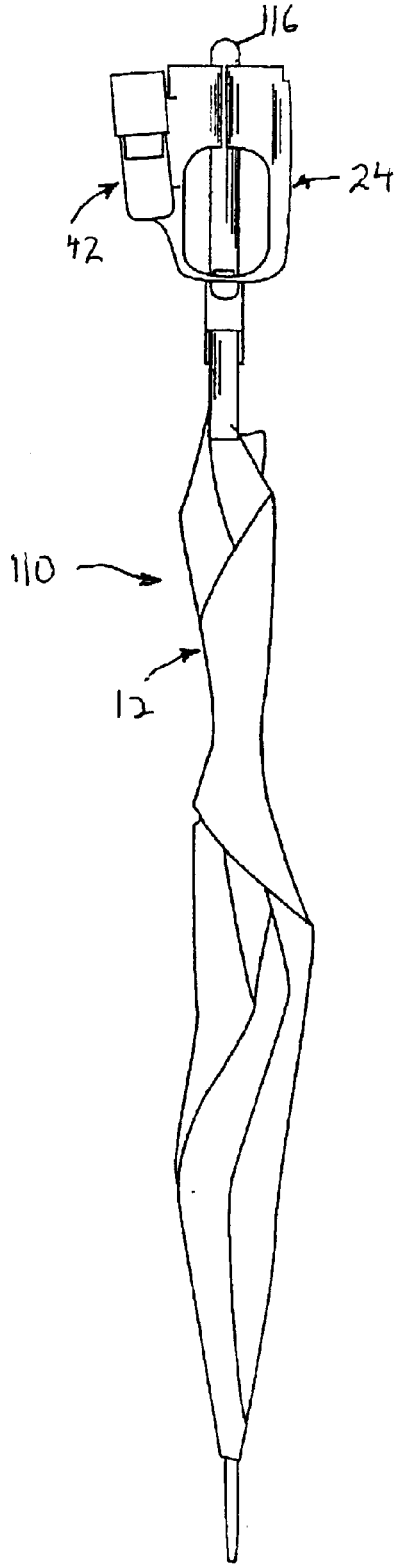
FIG. 12 is a front elevational view of the umbrella and article holder of FIG. 8.
Figure 13:
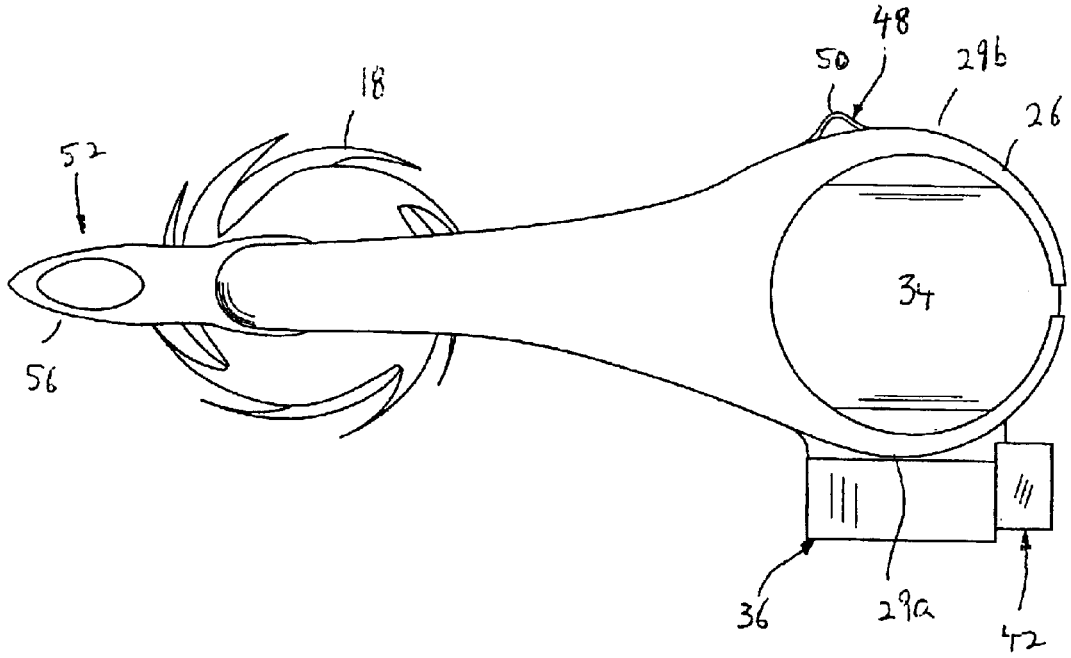
FIG. 13 is a top plan view of the umbrella and article holder of FIG. 8.
Figure 14:
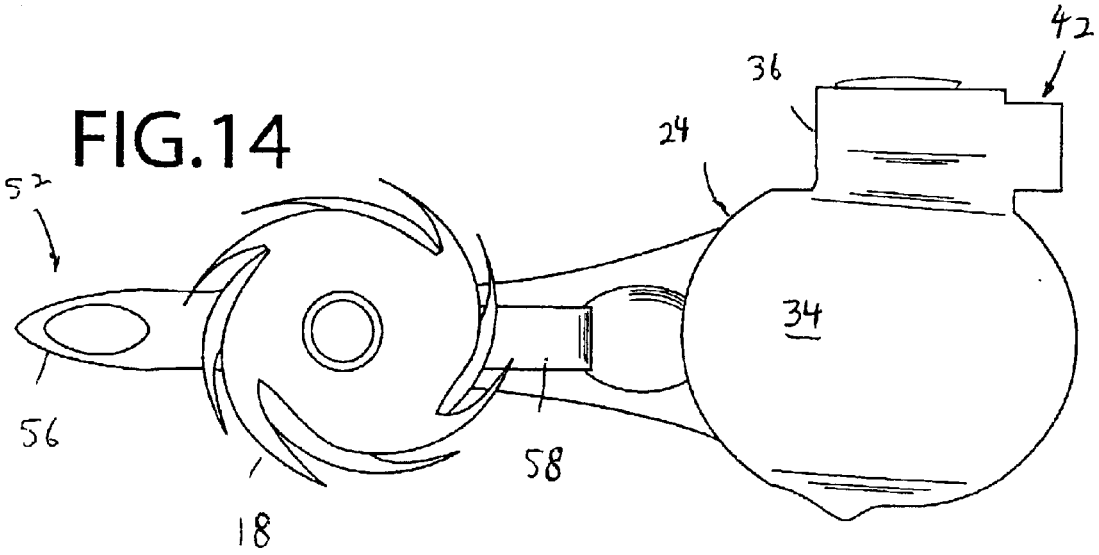
FIG. 14 is a bottom plan view of the umbrella and article holder of FIG. 8.

Umbrella 10 is formed with a plurality of holders 20 for holding different items when umbrella is held upright in the position shown in FIGS. 2 and 3. Specifically, an extension 22 extends outwardly in a substantially perpendicular relation from the upper end of handle 16, and terminates in a cup or bottle holder 24 as a first holder 20. Cup or bottle holder 24 includes an annular plate 26 at the outer end of extension 22, with annular plate 26 having an open slot 28 along the entire height thereof at a position substantially in diametrical relation to the connection to extension 22 so as to form first and second gripping arms 29*a* and 29*b* which can be biased outwardly to accommodate different size cups or bottles and which are resilient so as to return to their original position. A first extension plate 30 extends down from gripping arm 29*a* at one side of annular plate 26 and a second extension plate 32 extends down from gripping arm 29*b* at the other side of annular plate 26, with the lower ends of extension plates 30 and 32 being connected to the periphery of a substantially circular bottom plate 34. In this manner, a cup or bottle can be inserted in cup or bottle holder 24 and held therein when umbrella 10 is held upright.

A cigarette box holder 36 as a further holder 20 is secured to the outer surface of first extension plate 30 and gripping arm 29*a,* and is formed as a generally rectangular parallelepiped box 38 having an open upper end 39 through which a cigarette box (not shown) can be inserted and held therein, with a closure flap 40 hinged to the upper end of box 38 substantially at its connection to gripping arm 29*a*. Closure flap 40 can be releasably secured to the outer facing surface 38*a* of box 38 by any suitable means, such as the hook and loop fastener arrangement sold under the trademark "VELCRO", a snap arrangement, or simply by providing a slot 41 in the outer facing surface 38*a* of box 38 through which the free end of closure flap 40 can fit. In the latter case, the free end of closure flap 40 would taper in width. It will be appreciated that cigarette box holder 36 can be used to hold other items, such as chewing gum, candy bars, coins, a bus or subway card, etc.

A cigarette lighter holder 42 as a further holder 20 is secured to a side surface 38*b* of box 38, and is formed as a generally rectangular parallelepiped box 44 having an open upper end through which a cigarette lighter can be inserted and held therein, with a cover removably insertable over the upper open end of box 44. Alternatively, a closure flap similar to closure flap 40 can be provided on box 44.

Further, a pen holder 48 is provided on the outer surface of second extension plate 32 and gripping arm 29*b*. In this regard, pen holder 48 includes a part cylindrical plate 50 secured along the height of the outer surface of second extension plate 32 for receiving and holding a pen therein. The clip normally found on a pen can secured over the wall of part cylindrical plate 50 to releasably retain the pen in pen holder 48.

Although holders 24, 36, 42 and 48 have been discussed as being separately attached to handle 16, holders 24, 36, 42 and 48 are preferably formed integrally as a single piece in a molding operation with handle 16.

In addition, a hanging holder 52 as a further holder 20 is secured to a lower end of handle 16 where it connects with umbrella shaft 14, so as not to interfere with holders 24, 36, 42 and 48. Hanging holder 52 includes a main body 54 connected in surrounding relation with handle 16, and including a first extension 56 which extends outwardly from main body 54. Preferably, as shown best in FIGS. 2 and 3, the upper surface 56*a* of first extension 56 has a depression 56*b* therein. First extension 56 functions to hold the handles of a shopping bag, with depression 56*b* preventing the shopping bag handles from sliding off of upper surface 56*a*. First extension 56 may also be made hollow to reduce the weight thereof.

Hanging holder 52 further includes a hook 58 that extends outwardly from main body 54 in diametrically opposite relation to first extension 56 for hanging a coat or hat thereon.

Although holders 24, 36, 42, 48 and 52 have been discussed as being separately attached to handle 16, holders 24, 36, 42 and 52 are preferably formed integrally as a single piece in a molding operation with handle 16.

In addition, a magazine holder 60 as a further holder 20 is removably mounted around umbrella 10, and more particularly, around fabric covering 18 when umbrella 10 is in the closed configuration. Magazine holder 60 includes a back wall 62 of a generally rectangular configuration and which can also be slightly arcuate, side walls 64 and 66 which extend out from opposite side edges of back wall 62 from the bottom edge thereof to a position about two-thirds of the height of back wall 62, a front wall 68 which connects together opposite front edges of side walls 64 and 66, and a bottom wall 69 connecting the bottom edges of walls 62, 64, 66 and 68, thereby defining an enclosure having an open end 70 at the upper edges of side walls 64 and 66 and front wall 68, through which magazines can be inserted and held therein.

A rear cross member 74 extends between and is connected to opposite side edges of back wall 62 at a position just above open end 70, and is slightly arcuate so as to define a gap through which umbrella 10 can extend, and more particularly, through which fabric covering 18 can extend. In addition, transverse arcuate cross members 76 and 78 are spaced apart and connect a central section of back wall 62 with a central section of rear cross member 74. In this regard, back wall 62, rear cross member 74 and transverse cross members 76 and 78 together define a substantially circular opening 80 through which fabric covering 18 extends with a slight friction fit. As a result, magazine holder 60 can be pushed up along umbrella 10 to the position shown, for example, in FIGS. 15 and 16. The position shown in FIGS. 1–7 is lower than the operative position, and is shown in a lower position solely for better clarity in the drawings.

Preferably, front panels 82 and 84 are secured to opposite front edges of side walls 64 and 66 in slightly spaced relation above front wall 68. The inner ends of front panels 82 and 84 are connected together by an elastic strap 86 such that there is an opening 88 defined between the lower edge of elastic strap 86 and the upper edge of front wall 68, between front panels 82 and 84. In this manner, elastic strap 86 can be pulled out, thereby also pulling out front panels 82 and 84 to place one or more magazines through open end 70 into magazine holder 60, or to remove one or more magazines from magazine holder 60. When released, elastic strap 86 serves to elastically hold the magazines in magazine holder 60. In addition, elastic strap 86 can be grasped, due to opening 88, to pull magazine holder 60 up along umbrella 12 to adjust the position thereof on umbrella 12. Preferably, umbrella holder 60 is pulled up to the position shown in FIGS. 15 and 16.

FIGS. 8–14 show an umbrella 110 of a second embodiment which is substantially identical to umbrella 10 of the first embodiment, except that handle 116 has a curved configuration, as is conventional. All other aspects of umbrella 110 are substantially identical to that of umbrella 10 and a detailed discussion thereof will be omitted herein. Thus, the same numerals as umbrella 10 are used for the remaining elements.

Figure 15:
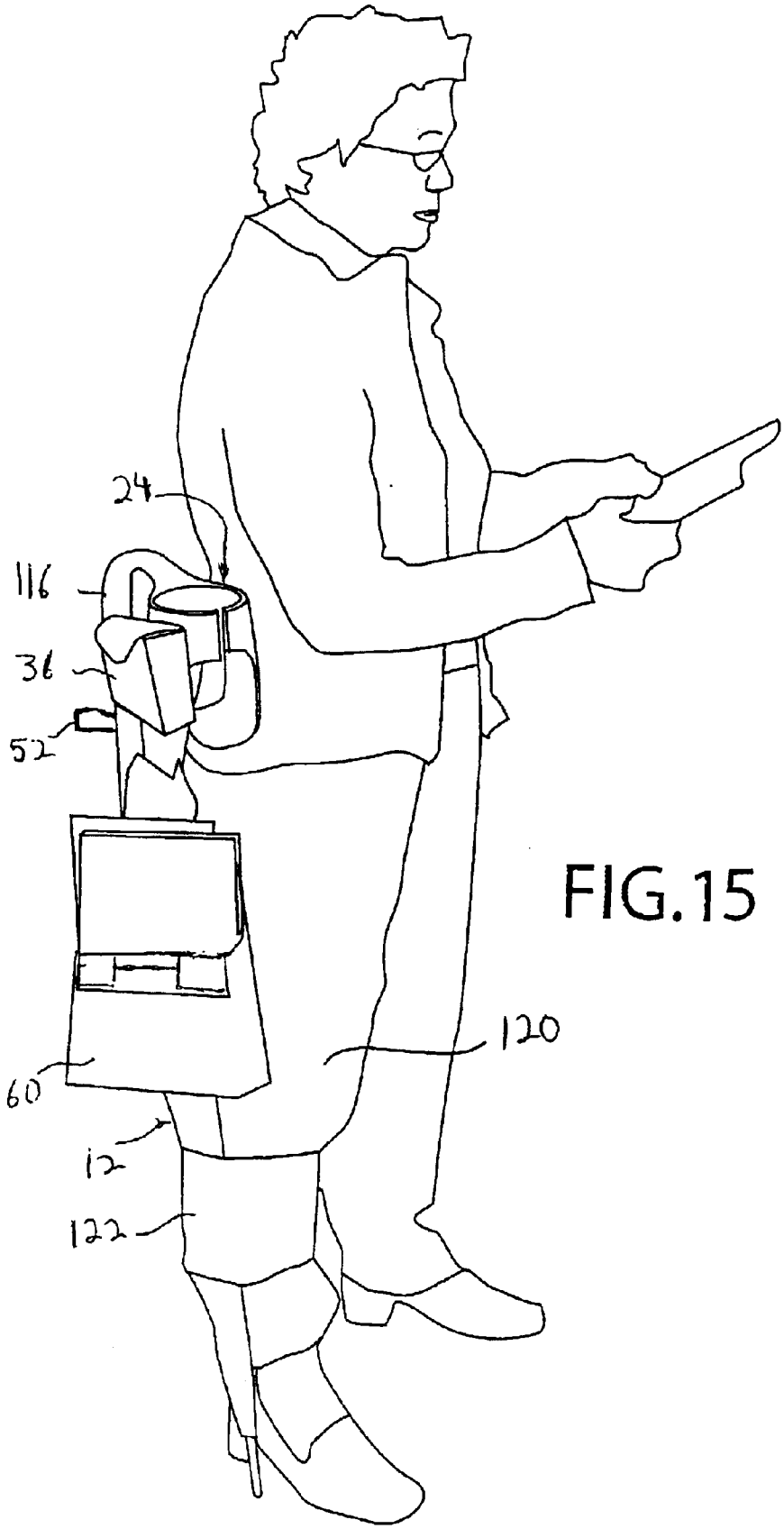
FIG. 15 is a perspective view of the umbrella and article holder of FIG. 8, secured to a leg of a person that is standing.
Figure 16:
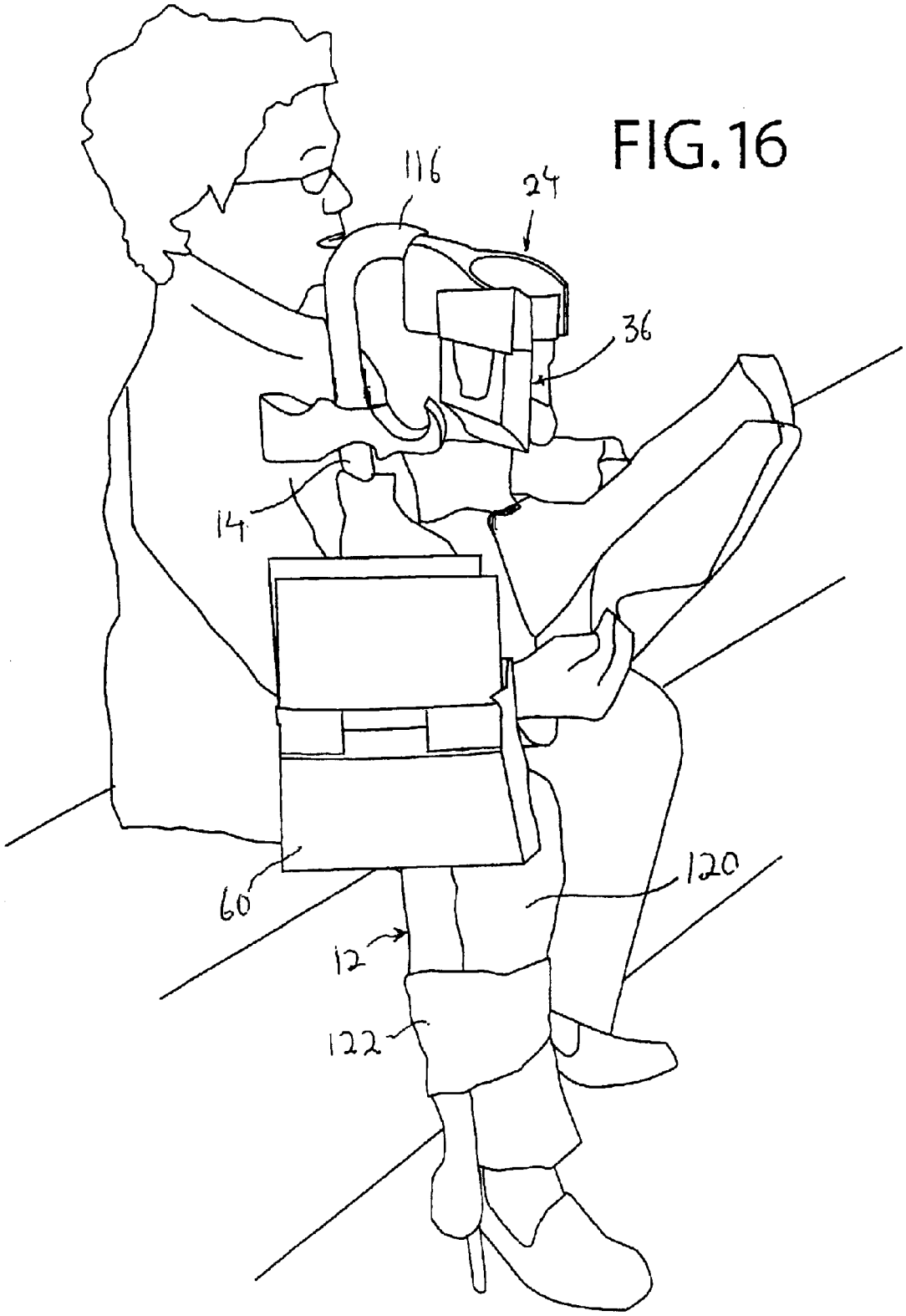
FIG. 16 is a perspective view of the umbrella and article holder of FIG. 8, secured to a leg of a person that is sitting.

In accordance with an aspect of the present invention, umbrella 10 or 110 can be secured to a leg 120 of a person when the person is standing or sitting, as shown in FIGS. 15 and 16, such that umbrella 10 or 110 remains in an upright position. Umbrella 110 is shown in FIGS. 15 and 16. In this regard, as shown in FIGS. 15–18, an elongated flexible fabric strap 122 is provided which has a narrower end portion 124 that extends for about one-third the length of strap 122. Three slightly spaced apart loop like fastener sections 126*a,* 126*b* and 126*c* are provided at the distal end of narrower end portion 124 on a first side of strap 122. Two slightly spaced apart loop like fastener sections 128*a* and 128*b* are provided at the proximal end of narrower end portion 124 on the first side of strap 122, rearwardly of fastener sections 126*a*–126*c*. An elastic strap 130 has its opposite ends secured at the opposite edges of strap 122 so as to extend across the first side of strap 122 and is located rearwardly of fastener sections 128*a* and 128*b*. A transverse slot 132 is formed in strap 122 rearwardly of elastic strap 130 and is located near the lengthwise center of strap 122. Further, a loop like fastener section 134 is formed on the first side of strap 122, about midway between the opposite end of strap 122 and slot 132.

The opposite second side of strap 122 includes a hook like fastener section 136 substantially in lengthwise alignment with loop like fastener section 126*c,* and the opposite end of strap 122 on the second side thereof includes slightly spaced apart hook like fastener sections 138*a* and 138*b*.

The loop like fastener sections and hook like fastener sections are preferably those commonly sold under the trademark "VELCRO."

In operation, narrower end portion 124 is inserted through slot 132 such that hook like fastener section 136 engages with one of the loop like fastener sections 128*a* or 128*b* to form a small diameter circular enclosure. The lower end of umbrella 12 is inserted through this small diameter circular enclosure. Then, the small diameter circular enclosure with the umbrella 12 therein is positioned against the outer facing surface of the calf muscle of the person's leg. Thereafter, the opposite end of strap 122 is wrapped about the person's leg and also about the small diameter circular enclosure such that hook like fastener sections 138*a* and 138*b* engaged with loop like fastener sections 126*a*–126*c,* as shown in FIGS. 15 and 16.

With this arrangement, umbrella 10 remains upright, whether the person is sitting or standing in order to hold various items therein.

Thus, umbrella 10 can be used as a normal umbrella by inverting the same, holding umbrella 10 by handle 16 and then opening fabric covering 18 in a protective manner. When not in use as a protective covering, umbrella 10 can serve as a holder for various items. For example, if a person has a one hour wait for a train, the person straps umbrella 10 to the person's leg by means of strap 122 and the loop like fasteners and hook like fasteners, so that umbrella 10 remains upright. Prior to strapping umbrella 10 to the person's leg, umbrella 10 is inserted through opening 80 so that magazine holder 60 is held on umbrella 10 by a friction fit with fabric covering 18. Magazine holder 60, along with magazines, can be held in a person's briefcase. Then, the person can place a box of cigarettes in cigarette box holder 36, a lighter in cigarette lighter holder 42, a pen in pen holder 48 and a drink in cup or bottle holder 24. The person can also hang a shopping bag from first extension 56 and the person's hat and/or coat from hook 58. In effect, umbrella thereby functions as a multi-purpose holder for holding a plurality of different items that are readily accessible to the person, while umbrella 10 is also retained in the upright position. Therefore, the effect of strap 122 is to hold umbrella 10 in this upright position in order for the various holders 20 to hold the different items thereon.

In the event that umbrella 10 is much smaller in diameter, an insert 140, as shown in FIG. 19, can be rolled into a circular configuration and placed within the small diameter circular enclosure formed by strap 122.

Figure 20:
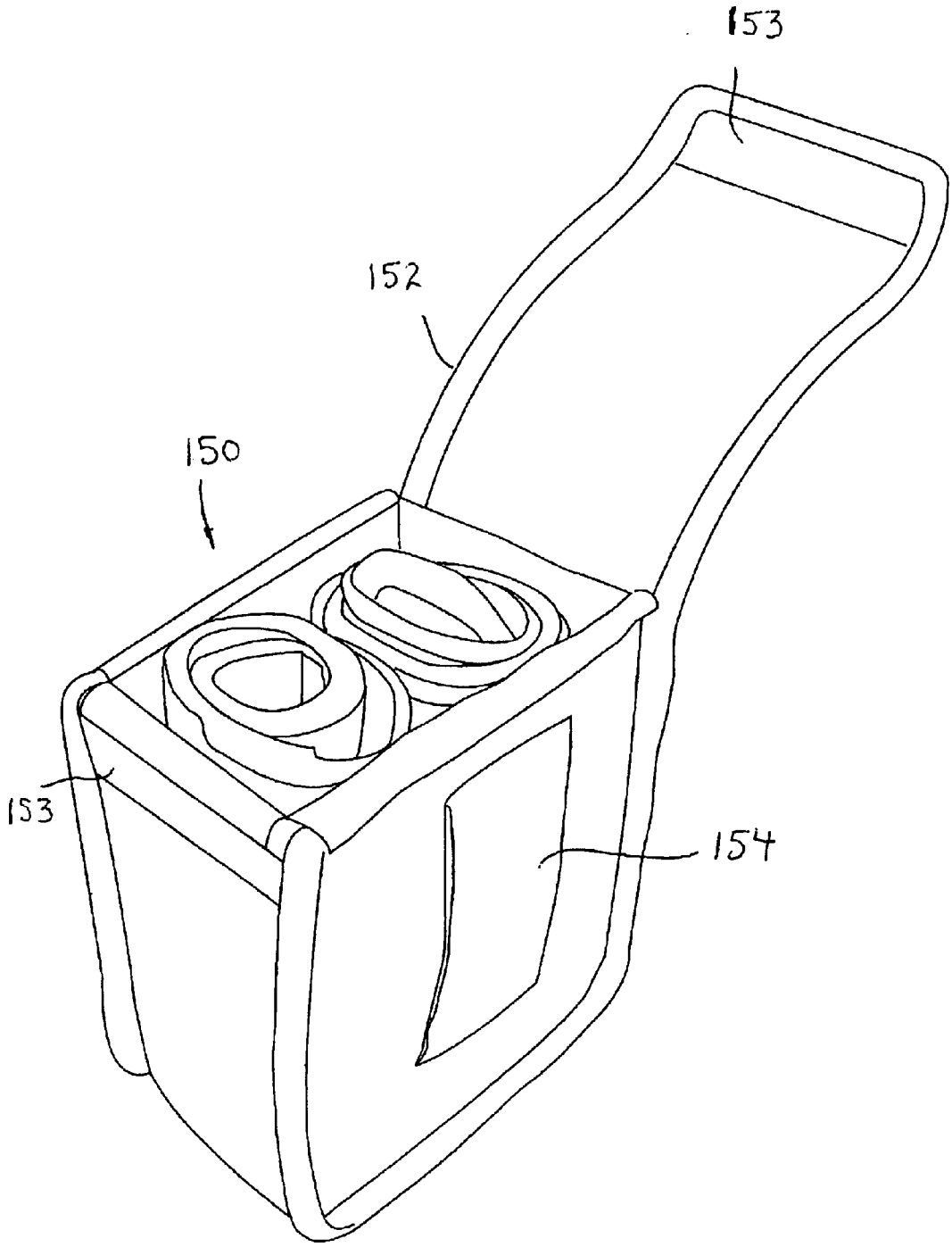
FIG. 20 is a perspective view of a carrying case for carrying the securing strap and insert.
Figure 21:
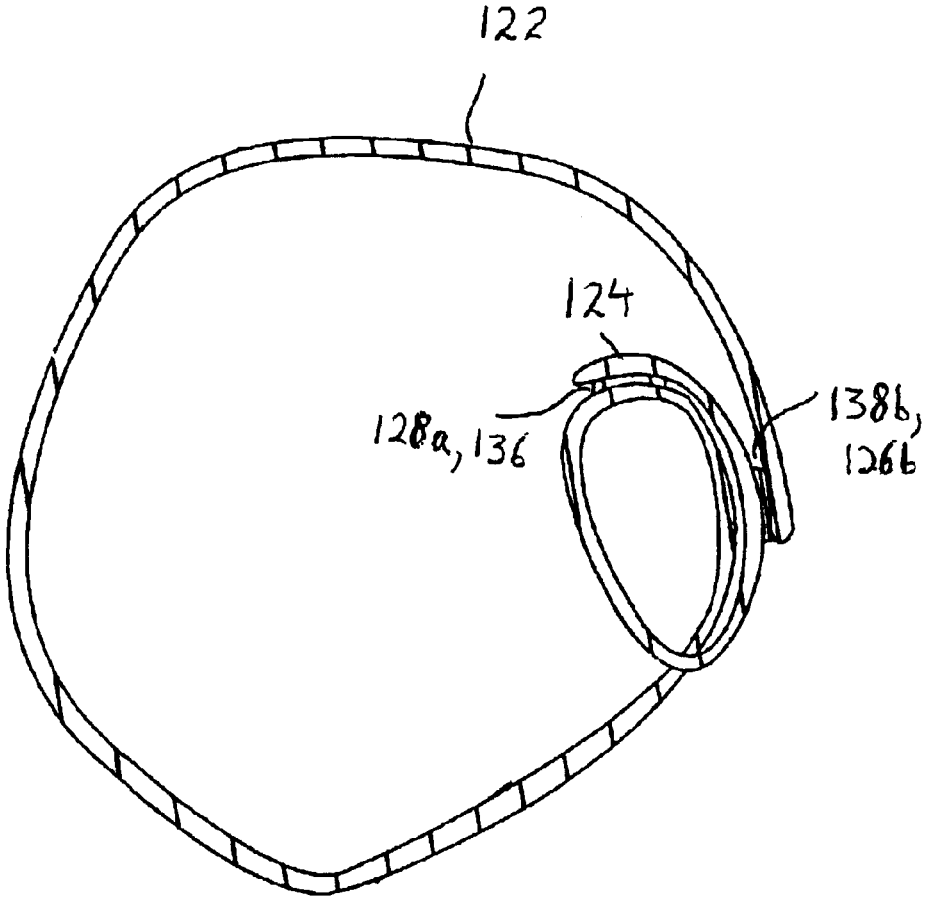
FIG. 21 is a cross-sectional view of the securing strap holding an umbrella to a leg of a person.

Strap 122 can be held in a person's briefcase or carried in a separate case 150, which is shown in FIG. 20. Case 150 preferably has a box-like or parallelepiped configuration with a hinged cover 152 that can be secured by any suitable arrangement, such as the hook and loop fastener arrangement 153 sold under the trademark "VELCRO", a snap arrangement or the like. In this regard, strap 122 and/or insert 140 can be rolled into a cylindrical configuration and stored in case 150. A strap 154 has its opposite ends secured vertically to an outer wall of case 150, and can receive a belt loop therethrough so that case 150 can be carried on a person's belt.

Thus, with the present invention, an umbrella and article holder is provided in which umbrella 10 or 110 has various holders 20 molded into and/or secured to handle 16 for holding various items therein when umbrella 10 or 110 is held upright. In such case, a leg strap 122 is provided for securing umbrella 10 or 110 to a leg of a person to maintain the umbrella in an upright position, whether the person is standing or sitting, in order to hold the items in holders 20 of handle 16.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. An umbrella and article holder comprising:

an umbrella having a shaft, a handle connected to one end of said shaft, and a fabric covering connected to an opposite end of said shaft and adapted to open up to provide a protective covering against rain, snow and sleet:

at least one article holder connected with the handle of the umbrella for holding at least one article when the umbrella is held in an upright configuration; and a leg securing device for securing the umbrella to a leg of a person such that the umbrella remains in the upright configuration whether the person is sitting or standing, said legs securing device including a strap for securing the umbrella to the leg of the person, wherein said strap includes at least one hook fastener section and at least one loop fastener section on opposite sides thereof for engagement with each other to secure the strap around the leg of the person and around the umbrella, wherein said strap includes a slot for receipt of one end of said strap such that said one end extending through said slot can be secured to the strap by the at least one hook fastener section and the at least one loop fastener section to form a small diameter enclosure for wrapping about the umbrella, and wherein an opposite end of said strap includes one of said at least one hook fastener section and at least one loop fastener section and is adapted to be wrapped about a leg of a person and about said small diameter enclosure to engage with at least one other loop fastener section and at least one other hook fastener section on said strap to secure said strap about the leg of the person and about said small diameter enclosure.

2. An umbrella and article holder according to claim 1, wherein said strap includes a narrower width end portion which includes said one end.

3. An umbrella and article holder according to claim 1, wherein said at least one article holder includes a drink holder.

4. An umbrella and article holder according to claim 1, wherein said at least one article holder includes a cigarette box holder.

5. An umbrella and article holder according to claim 1, wherein said at least one article holder includes a cigarette lighter holder.

6. An umbrella and article holder according to claim 1, wherein said at least one article holder includes a pen holder.

7. An umbrella and article holder according to claim 1, wherein said at least one article holder includes a hook for holding at least one of a hat and coat.

8. An umbrella and article holder according to claim 1, wherein said at least one article holder includes an extension for holding a shopping bag.

9. An umbrella and article holder according to claim 1, wherein said at least one article holder includes a drink holder, cigarette box holder, cigarette lighter holder and pen holder connected to an upper end of the handle, and a hook for holding at least one of a hat and coat and an extension for holding a shopping bag connected to a lower end of the handle.

10. An umbrella and article holder comprising:

an umbrella having a shaft, a handle connected to one end of said shaft, and a fabric covering connected to an opposite end of said shaft and adapted to open up to provide a protective covering against rain, snow and sleet;

at least one article holder connected with the handle of the umbrella for holding at least one article when the umbrella is held in an upright configuration, wherein said at least one article holder is formed as a unitary, one-piece construction with said handle; and a leg securing device for securing the umbrella to a leg of a person such that the umbrella remains in the upright configuration whether the person is sitting or standing.

11. An umbrella and article holder according to claim 10, wherein said at least one article holder includes a drink holder.

12. An umbrella and article holder according to claim 10, wherein said at least one article holder includes a cigarette box holder.

13. An umbrella and article holder according to claim 10, wherein said at least one article holder includes a cigarette lighter holder.

14. An umbrella and article holder according to claim 10, wherein said at least one article holder includes a pen holder.

15. An umbrella and article holder according to claim 10, wherein said at least one article holder includes a hook for holding at least one of a hat and coat.

16. An umbrella and article holder according to claim 10, wherein said at least one article holder includes an extension for holding a shopping bag.

17. An umbrella and article holder according to claim 10, wherein said at least one article holder includes a drink holder, cigarette box holder, cigarette lighter holder and pen holder connected to an upper end of the handle, and a hook for holding at least one of a hat and coat and an extension for holding a shopping bag connected to a lower end of the handle.

18. An umbrella and article holder comprising:

an umbrella having a shaft, a handle connected to one end of said shaft, and a fabric covering connected to an opposite end of said shaft and adapted to open up to provide a protective covering against rain, snow and sleet;

at least one article holder connected with the handle of the umbrella for holding at least one article when the umbrella is held in an upright configuration;

a leg securing device for securing the umbrella to a leg of a person such that the umbrella remains in the upright configuration whether the person is sitting or standing;

a magazine holder having a magazine rack for holding at least one magazine; and a connector to which the magazine rack in mounted, the connector having an opening through which the umbrella is adapted to fit in a friction manner so that the magazine holder can be held at a desired height along the umbrella.

* * * * *